United States Patent [19]

Moeller

[11] Patent Number: 5,000,665

[45] Date of Patent: Mar. 19, 1991

[54] ADJUSTABLE FLOW MINI WHIRLPOOL JET

[75] Inventor: William L. Moeller, Trenton, N.J.

[73] Assignee: American Standard Inc., New York, N.Y.

[21] Appl. No.: 486,576

[22] Filed: Feb. 28, 1990

[51] Int. Cl.[5] ..... F04F 5/48

[52] U.S. Cl. ..... 417/188; 417/189; 417/196; 4/492; 4/544; 362/101

[58] Field of Search ..... 417/178, 182, 188, 189, 417/196, 198, 187; 4/490, 492, 541, 542, 543, 544

[56] References Cited

U.S. PATENT DOCUMENTS

| | | | |
|---|---|---|---|
| 646,111 | 3/1900 | Taylor | 417/188 |
| 2,608,801 | 9/1952 | Ridley | 417/183 |
| 3,515,502 | 6/1970 | Coordes | 417/178 |
| 4,089,622 | 5/1978 | Aubel et al. | 417/189 |
| 4,541,780 | 9/1985 | Moreland | 417/188 |
| 4,542,854 | 9/1985 | Mathis | 4/492 |
| 4,701,108 | 10/1987 | Scampini | 417/187 |
| 4,727,605 | 3/1988 | Henkin et al. | 4/544 |

*Primary Examiner*—Michael Koczo
*Assistant Examiner*—Michael Kocharov
*Attorney, Agent, or Firm*—Blum Kaplan

[57] ABSTRACT

A whirlpool jet assembly adapted to be mounted in an opening in the wall of a water tub for discharging the water stream into the tub. The jet assembly includes a housing defining a socket having an air inlet and a water inlet and a ball fitting pivotably supported within the socket having openings positionable in alignment with the air and water inlets in the socket. A nozzle assembly supported on the ball fitting is of a unitary one-piece construction forming a Venturi nozzle, mixing chamber and directional nozzle in an integral structure. The nozzle assembly is rotatably supported on the ball fitting with the ball fitting and nozzle assembly having shaped openings through which water from the water inlet flows into the Venturi jet nozzle. Rotation of the nozzle assembly with respect to the ball fitting changes the combined shape of the shaped openings to alter the pressure of water flowing through the jet assembly.

10 Claims, 12 Drawing Sheets

FIG. 8a
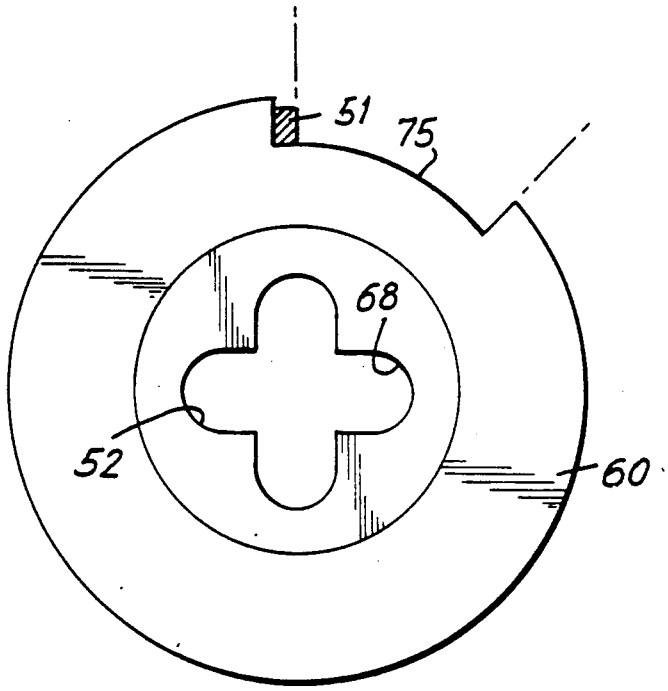
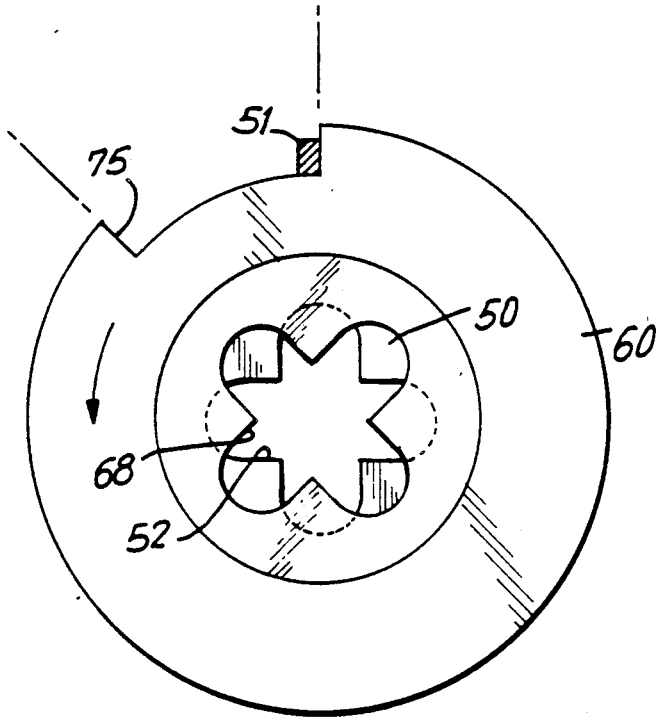
FIG. 8b

ADJUSTABLE FLOW MINI WHIRLPOOL JET

BACKGROUND OF THE INVENTION

The present invention is directed generally to a whirlpool jet for use in hydrotherapy systems or the like which can be mounted to bathtubs, hot tubs, spas or the like and, in particular, to a mini whirlpool jet having a nozzle assembly of unitary one-piece construction wherein the flow of water through the nozzle assembly can be easily adjusted.

Conventional whirlpool jets of the type under consideration generally include a housing adapted to be coupled to an opening in the peripheral wall of a tub or other water enclosure. The housing includes a water inlet through which water under pressure is supplied to the housing and an air inlet through which air is supplied to the housing. A stationary Venturi nozzle is positioned to receive water from the water inlet and air is supplied proximate the tip of the Venturi nozzle which becomes entrained with the water stream flowing out of the nozzle to increase the pressure thereof under the Venturi effect. A separate directional nozzle is positioned in line with the Venturi nozzle and is generally manually adjustable to permit adjustment of the flow direction of the jet stream. Such a conventional system is disclosed, for example, in U.S. Pat. No. 4,541,780.

The directional nozzle in such conventional systems may be an eyeball-type nozzle which swivels within the housing independent of the Venturi jet nozzle to permit the direction of flow to be adjusted. Because of the multi-part construction found in such conventional whirlpool jets, the whirlpool jets must generally be of a large size and therefore inconvenient and less pleasing. In addition, a coil compression spring is generally required to bias the eyeball fitting in the housing to hold the nozzle in a desired position.

It is also a desirable feature in whirlpool jets to permit adjustment of the flow of water out of the nozzle by a simple manipulation of the nozzle. While various systems have been proposed for permitting adjustment of the water flow, for example, the system disclosed in U.S. Pat. No. 4,542,854, all have proven less than completely satisfactory.

Accordingly, it is desired to provide an improved mini whirlpool jet having a nozzle assembly of a unitary one-piece construction which also permits ready adjustment of the water flow.

SUMMARY OF THE INVENTION

Generally speaking, in accordance with the present invention, a whirlpool jet assembly adapted to be mounted in an opening in the wall of a water tub for discharging a water stream into the tub, is provided. The whirlpool jet assembly includes a housing defining a socket having an air inlet and a water inlet. A unitary one-piece nozzle assembly is rotatably supported in the socket and includes a first portion forming a Venturi discharge nozzle open to the water inlet, an intermediate portion forming a mixing chamber open to the air inlet for receiving water from the Venturi discharge nozzle and mixing the air and water, and a second portion forming a directional nozzle for receiving the jet water stream from the mixing chamber and for directing the flow of water out of the nozzle assembly into the tub. The nozzle assembly is rotatably supported in a semi-spherical fitting adapted to pivot within the socket. Rotation of the nozzle assembly with respect to the eyeball fitting reduces the flow of water emerging through the nozzle assembly into the tub.

Accordingly, it is an object of the present invention to provide an improved whirlpool jet.

Another object of the present invention is to provide an adjustable flow mini whirlpool jet.

A further object of the present invention is to provide a mini whirlpool jet in which the direction of water flow can be changed without the need for springs or the like.

A still further object of the present invention is to provide an adjustable flow mini whirlpool jet with higher performance and providing a more soothing action.

Yet another object of the present invention is to provide a lighting system for use in connection with a whirlpool tub.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIGS. 8(*a*) and 8(*b*) are views into the nozzle as shown in FIG. 2 showing rotation of the nozzle to permit water flow adjustment;

DETAILED DESCRIPTION OF THE PREFERRED EMBODIMENTS

Figure 1A:
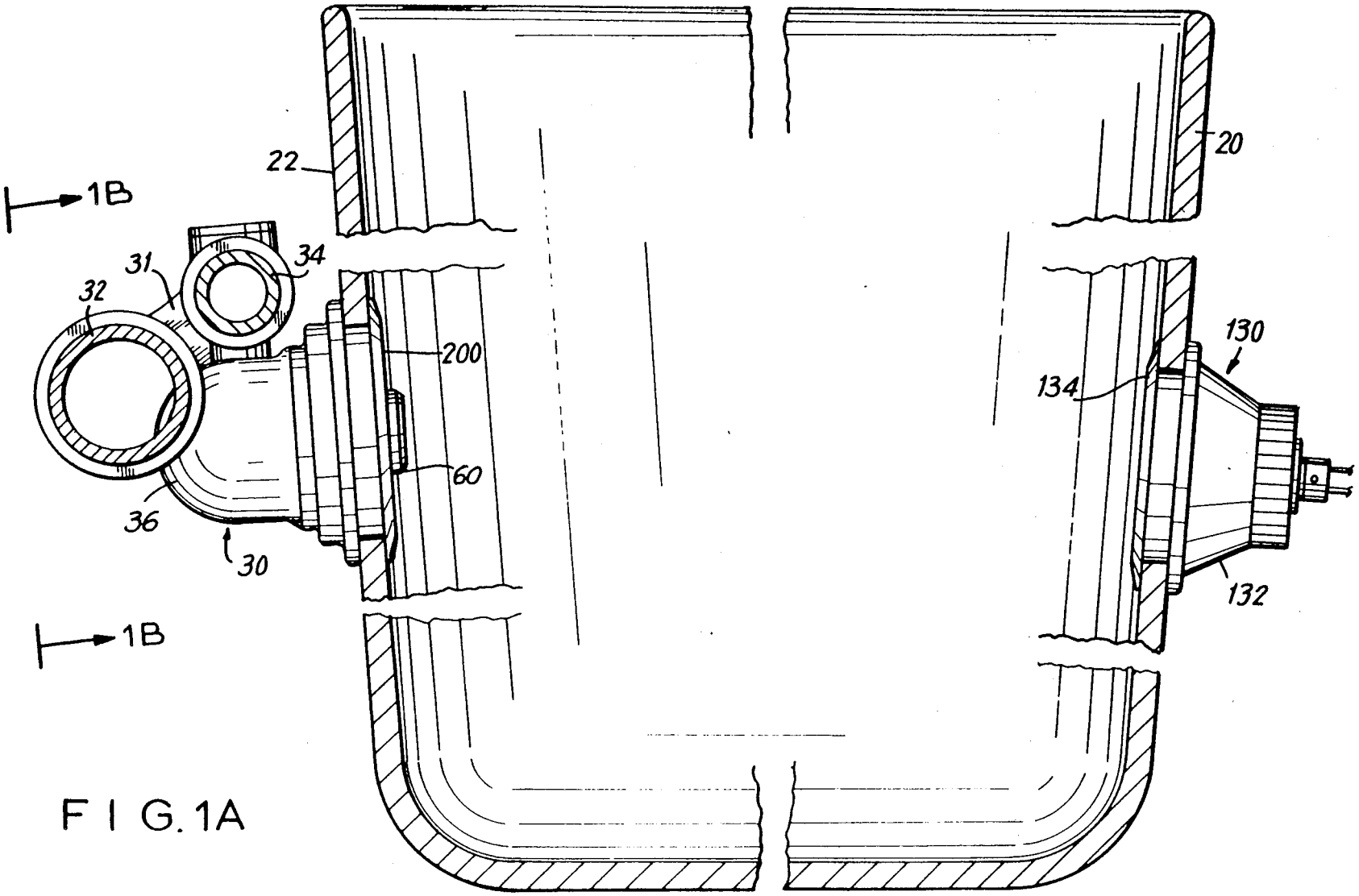
FIG. 1A is a sectional view of a water tub incorporating an adjustable flow mini whirlpool jet constructed in accordance with the present invention and a light assembly constructed in accordance with a further aspect of the present invention.

Reference is first made to FIG. 1A which depicts a water tub 20 such as a bathtub, hot-tub, spa or the like adapted to hold a desired amount of water. Coupled to peripheral wall 22 of tub 20 is a whirlpool jet assembly, generally indicated at 30, and constructed in accordance with a preferred embodiment of the present invention. Whirlpool jet assembly 30 includes a housing 31 which includes a water supply line 32 and an air supply line 34. A conventional pumping system (not shown) pumps water under pressure from within tub enclosure 20 through water supply line 32 into a socket 36 formed as part of housing 31. Air supply line 34 provides air to socket 36 to create a Venturi jet action as described below in detail.

Figure 1B:
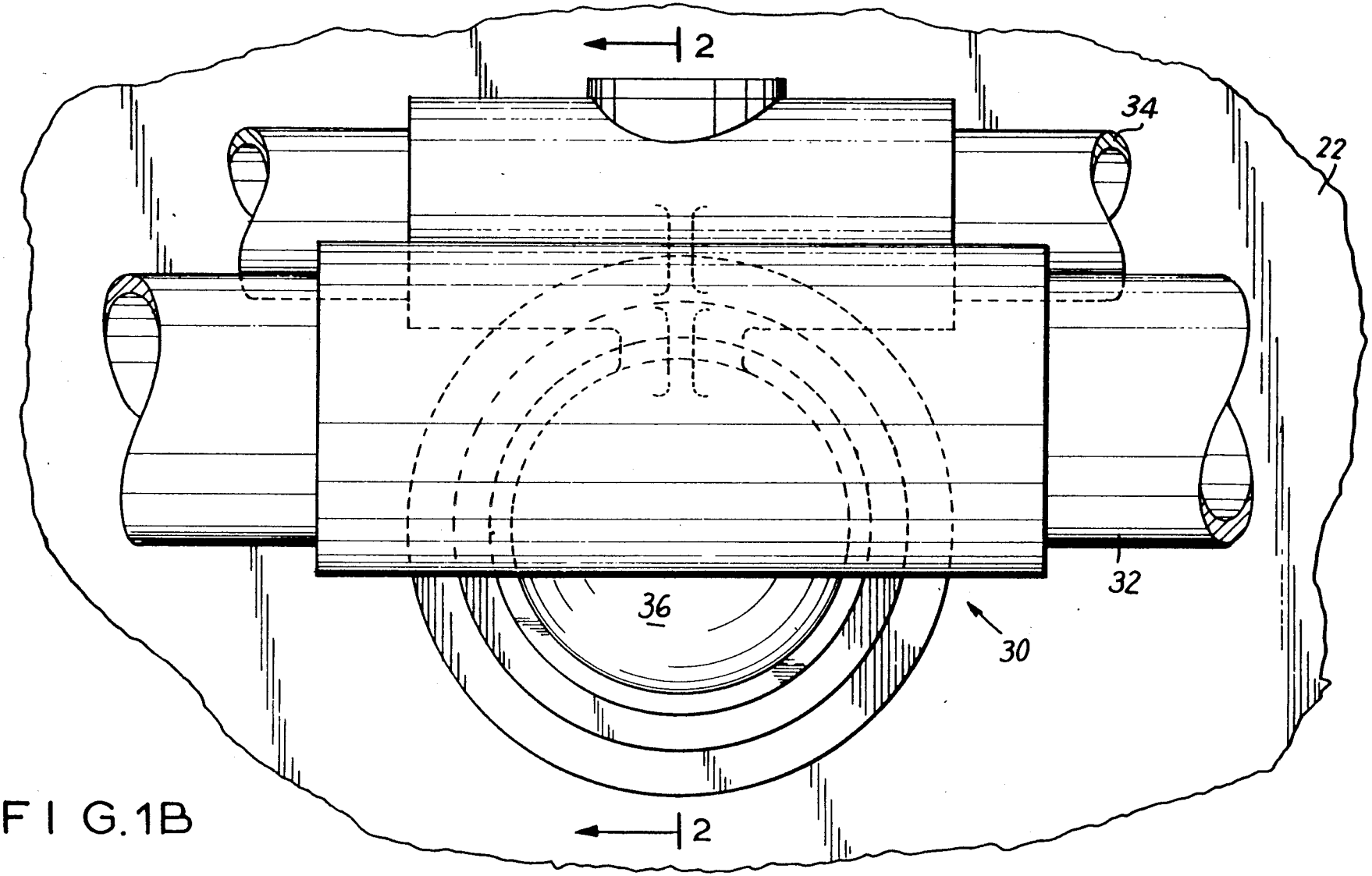
FIG. 1B is an enlarged partial elevational view taken along line 1B—1B of FIG. 1A.

In a complete system, a plurality of whirlpool jet assemblies 30 will be positioned in spaced fashion around tub 2 and water will be recirculated from within the tub through water conduit 32 into each socket 36 for ejection into the tub. FIG. 1B shows the manner in which water supply conduit 32 and air supply conduit 34 extend from whirlpool jet assembly 30 to permit coupling to similar whirlpool jet assemblies positioned at other locations on peripheral wall 22 of water tub 20

Referring now to FIGS. 2 through 5, it is seen that water supply line 32 includes water supply conduit 40 through which water from line 32 can flow into socket 36. Similarly, air supply line 34 includes an air supply conduit 42 through which air in air supply line 34 can be introduced into socket 36. Housing 31 also includes a first threaded section 44 and a second larger threaded section 46 as depicted.

Figures 7, 7C:
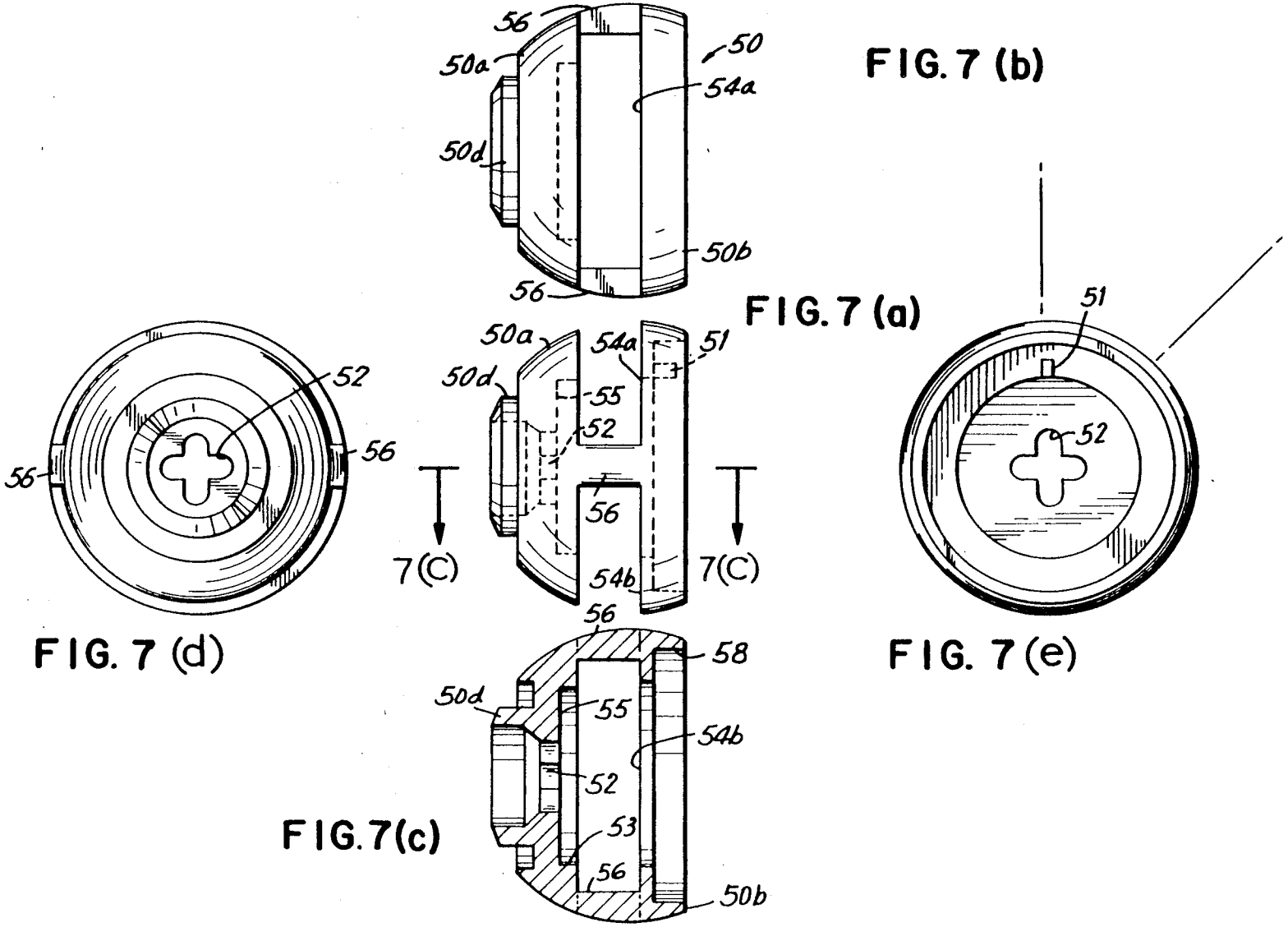
FIG. 7, parts (a) through (e) are various views of the back portion of the eyeball fitting of the whirlpool jet assembly of the present invention.

A ball fitting 50 is pivotably supported within socket 36. As best depicted in FIG. 7, ball fitting 50 is circular in front and rear plan views as shown by FIG. 7, parts (d) and (e), and is semispherical in shape in side elevation as best shown in parts (a), (b) and (c). A cross-shaped opening 52 is provided at a first end 50*a* of ball fitting 50 and is adapted to receive water from water line 32 through water conduit 40. Ball fitting 50 also includes centrally located cut-out regions 54*a* and 54*b* defined intermediate joining walls 56. A first recessed region 58 is formed in second end 50*b* of ball fitting 50 and is adapted to receive nozzle assembly 60 as described below in detail.

Figure 2:
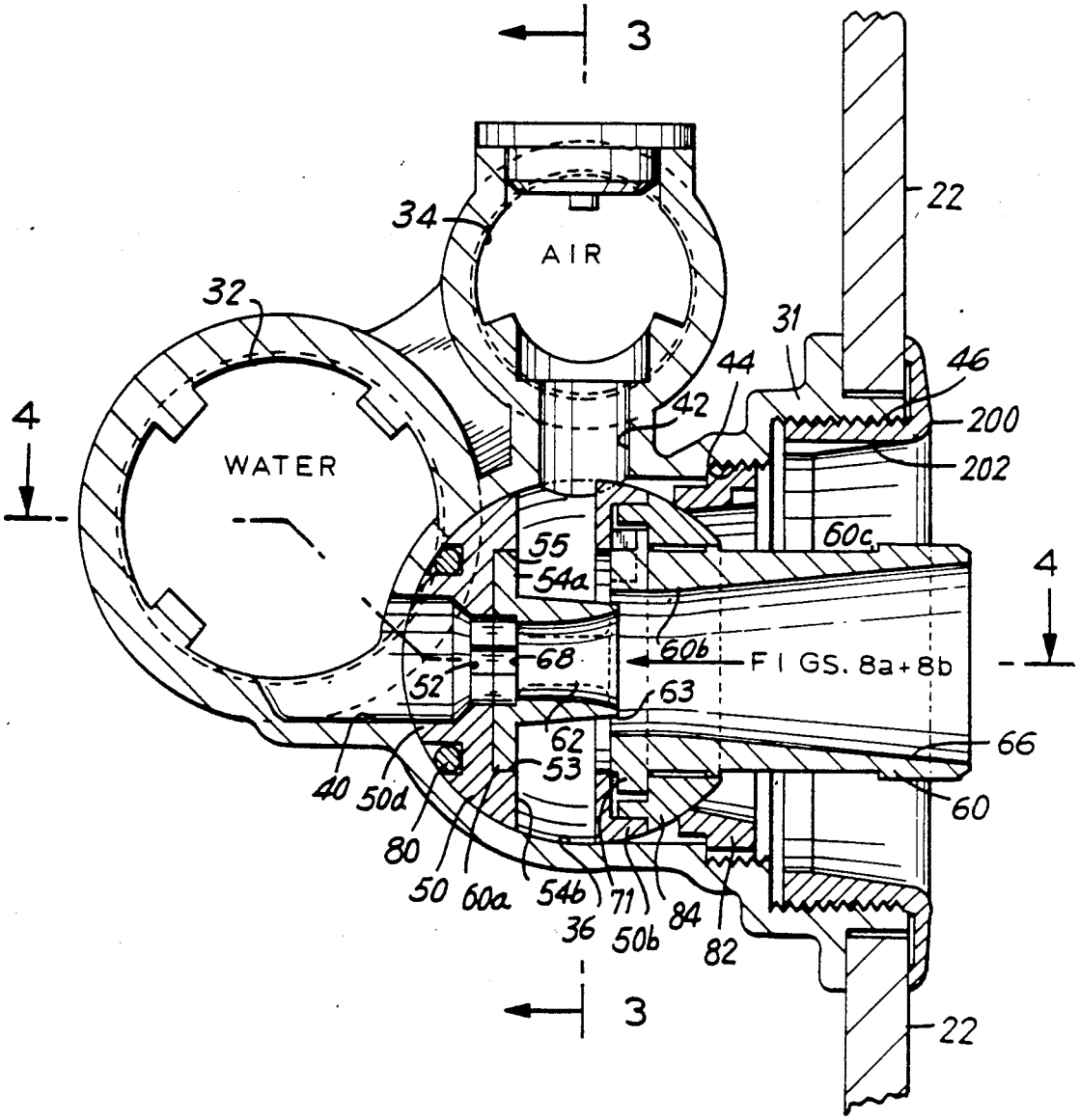
FIG. 2 is a sectional view taken along line 2—2 of FIG. 1B.
Figure 3:
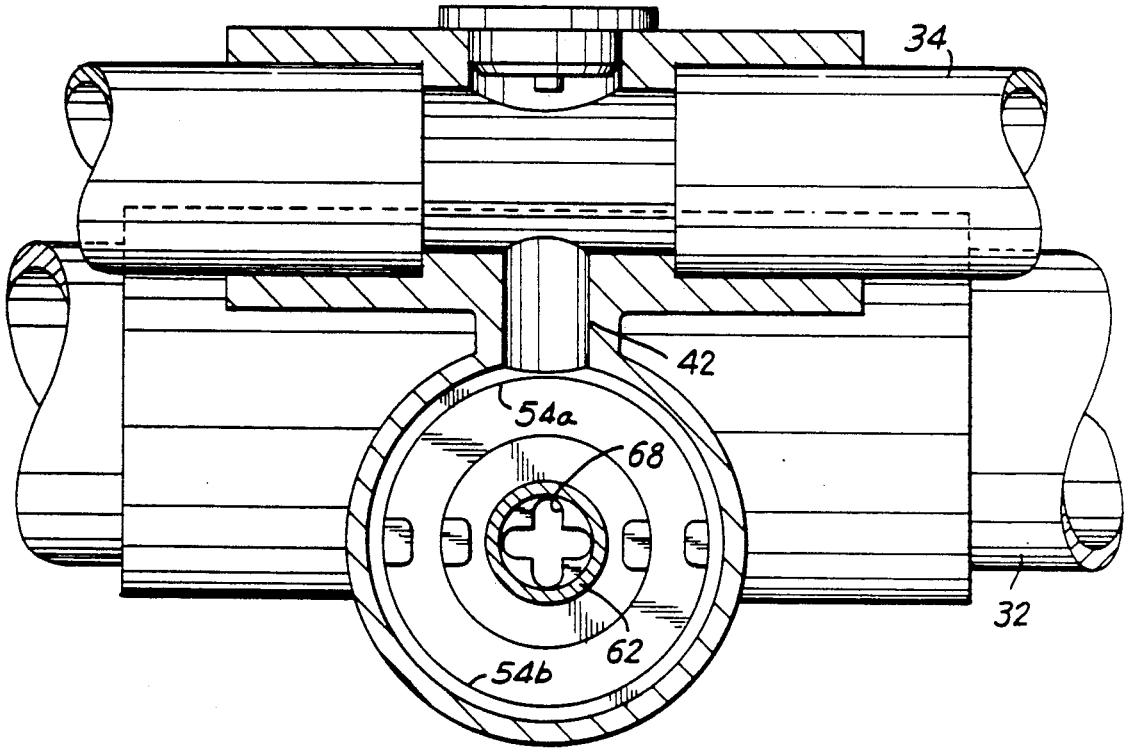
FIG. 3 is a sectional view taken along line 3—3 of FIG. 2.
Figure 4:
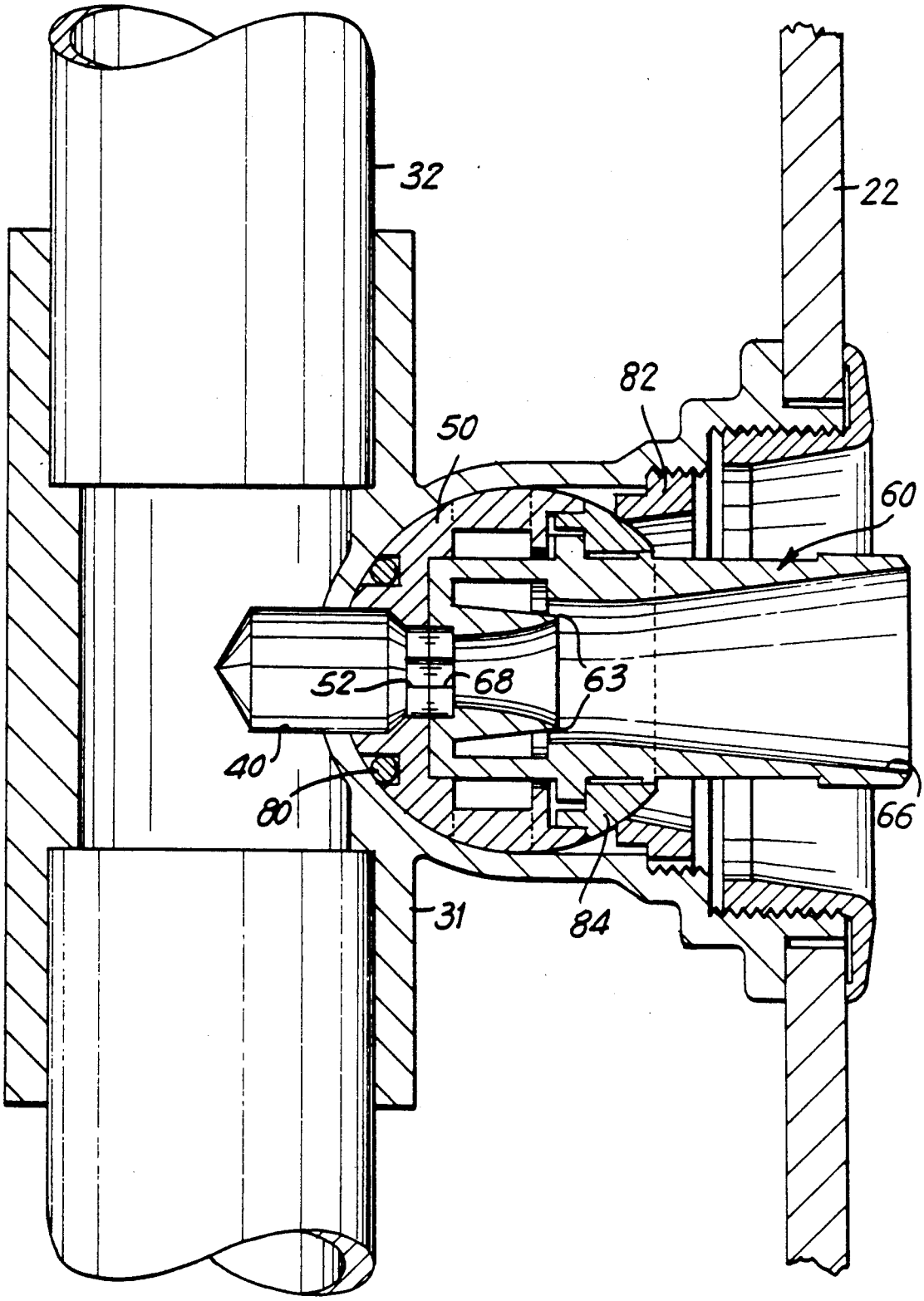
FIG. 4 is a sectional view taken along line 4—4 of FIG. 2.
Figure 5:
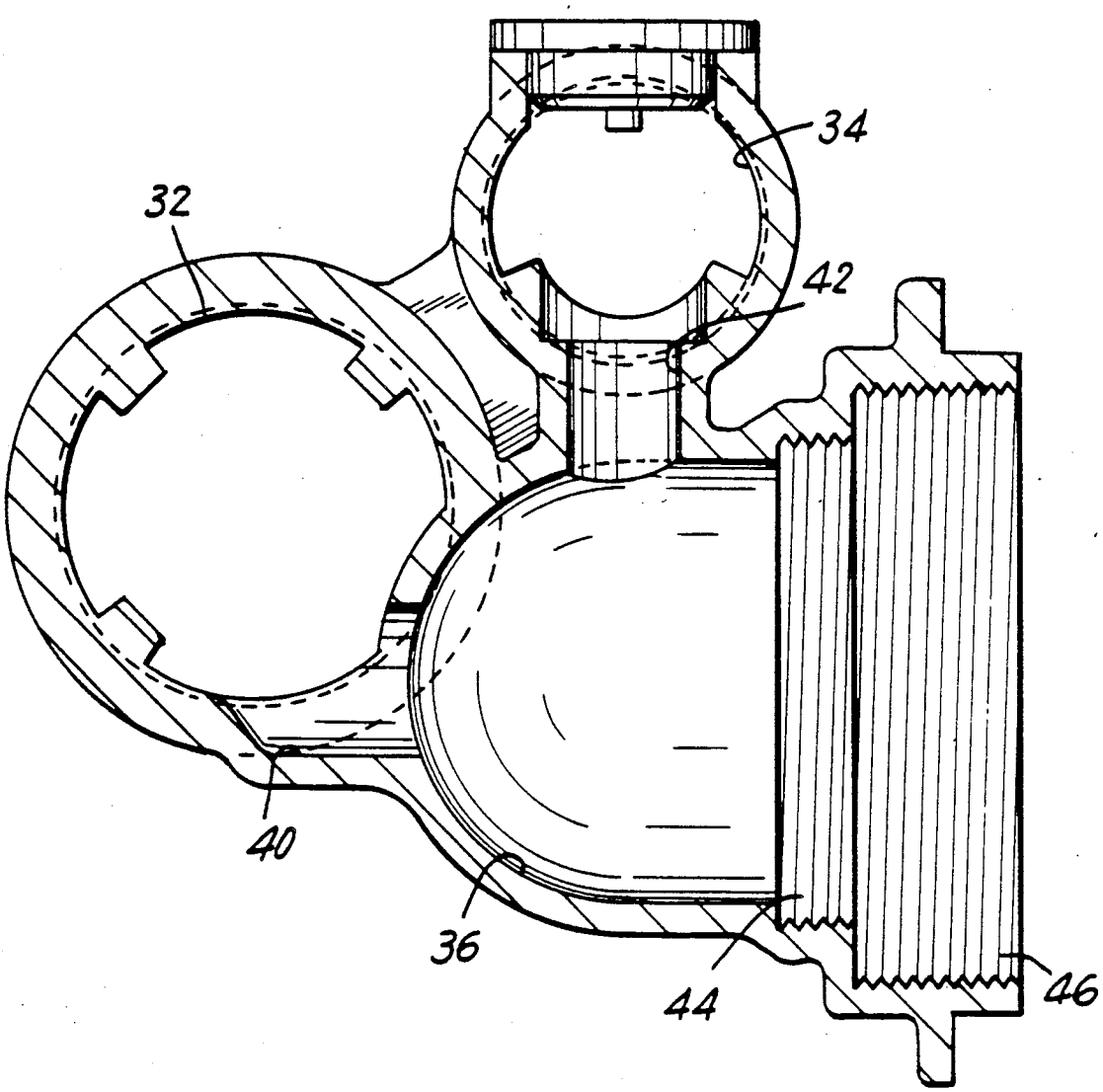
FIG. 5 is a sectional view similar to FIG. 2 but showing only the whirlpool jet assembly housing without auxiliary components of the system.
Figures 6A, 6B, 6C, 6D, 6E:
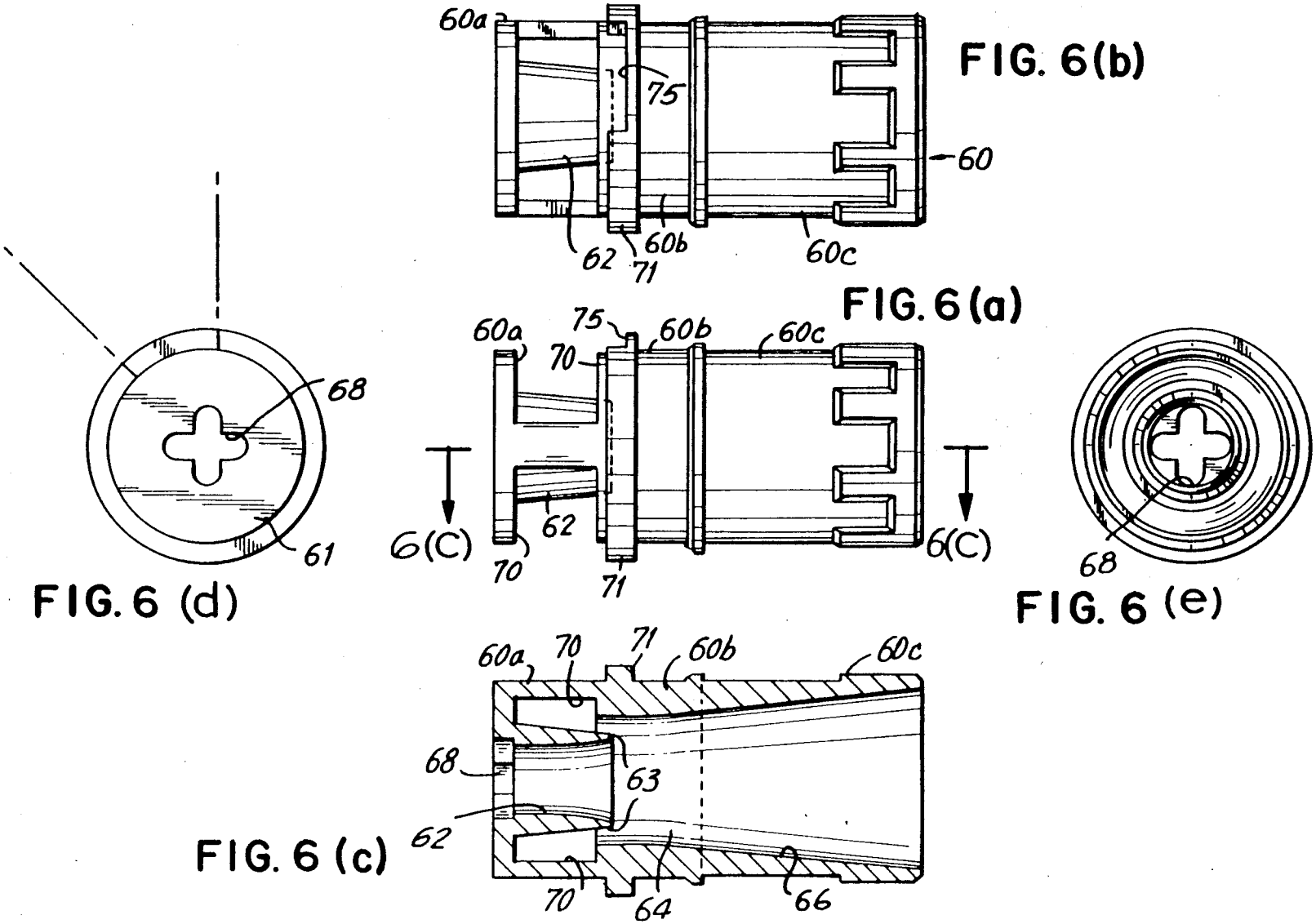
FIG. 6, parts (a) through (e) are various views of the unitary one-piece nozzle assembly used in the whirlpool jet assembly of the present invention.

Nozzle assembly 60, best depicted in FIGS. 2 and 6, is an integrally formed one-piece assembly which includes a first section 60*a* forming a Venturi jet nozzle 62, an intermediate section 60*b* defining a mixing chamber and an outer section 60*c* defining a directional nozzle 66. As depicted, directional nozzle portion 66 is a divergent nozzle, although it is recognized that nozzle portion 66 could instead be a convergent nozzle.

Cut-out regions 70 at first portion 60*a* of nozzle assembly 60 define openings through which air can be introduced to the jet stream of water forcefully flowing out of Venturi jet nozzle 62 through passageway 63 at the tip of nozzle 62.

First portion 60*a* of nozzle assembly 60 is sized to be received in ball fitting 50 as best depicted in FIG. 2. When so received, first portion 60*a* of nozzle assembly 60 will be received in a recessed region 53 in ball fitting 50 and back wall 61 will abut against interior wall 55 of ball fitting 50. Respective openings 52 and 68 in ball fitting 50 and nozzle assembly 60 will be in alignment to permit water from water supply line 32 to flow through water conduit 40 through opening 52 in ball valve 50, then through opening 68 in nozzle assembly 60 and into Venturi jet nozzle 62. Air from air supply line 34 will flow through air supply conduit 42 into opening 54*a* or 54*b* of ball fitting 50, then through opening 70 in nozzle assembly 60 and then through passageway 63 around the tip of Venturi nozzle 62 so that the air can become entrained within the water flowing out of Venturi nozzle 62 in mixing chamber portion 60*b* to create the Venturi effect. The water will then emerge out of directional nozzle portion 60*c* of nozzle assembly 60 and into tub 20.

As depicted in FIG. 2, it is seen that an O-ring seal 80 is provided around the back side 50*d* of first end 50*a* of ball fitting 50. O-ring seal 80 not only prevents leaks as water is flowing through conduit 40 into Venturi nozzle 62, but also resiliently biases ball fitting 50 in an outward direction. A compression nut 82 threaded in inner threads 44 presses against ball front 84 which holds nozzle assembly 60 in ball valve 50 through a flange 71. The biasing force exerted by O-ring 80 against compression nut 82 provides sufficient frictional force as nozzle assembly 60 is pivoted such that no coil springs as required in the prior art are necessary in the present invention to hold the nozzle in a desired orientation.

Referring to FIG. 7, it is seen that ball fitting 50 includes an internal projection 51 which is received in a slot 75 formed on flange 71 of nozzle assembly 60 as shown in FIG. 6. As best depicted in FIGS. 8(*a*) and 8(*b*), it is seen that nozzle assembly 60 can be rotated with respect to ball fitting 50 from a position where respective openings 52 and 68 in ball fitting 50 and nozzle assembly 60 are in alignment as shown in FIG. 8(*a*) to a position where openings 52 and 68 interfere to define a smaller opening to reduce the flow of water into Venturi nozzle 62. Projection 51 and slot 75 cooperate to permit a predetermined angle of rotation of nozzle assembly 60 with respect to ball fitting 50.

An escutcheon 200 having a recessed area 202 is threaded from the inside of tub 20 to threads 46 of housing 31 to hold the whirlpool jet assembly to wall 22 of tub 20. A gasket may also be used to prevent leaks. Tub wall thickness of between about ¼" to ½" are acceptable to permit proper mounting.

Figure 9:
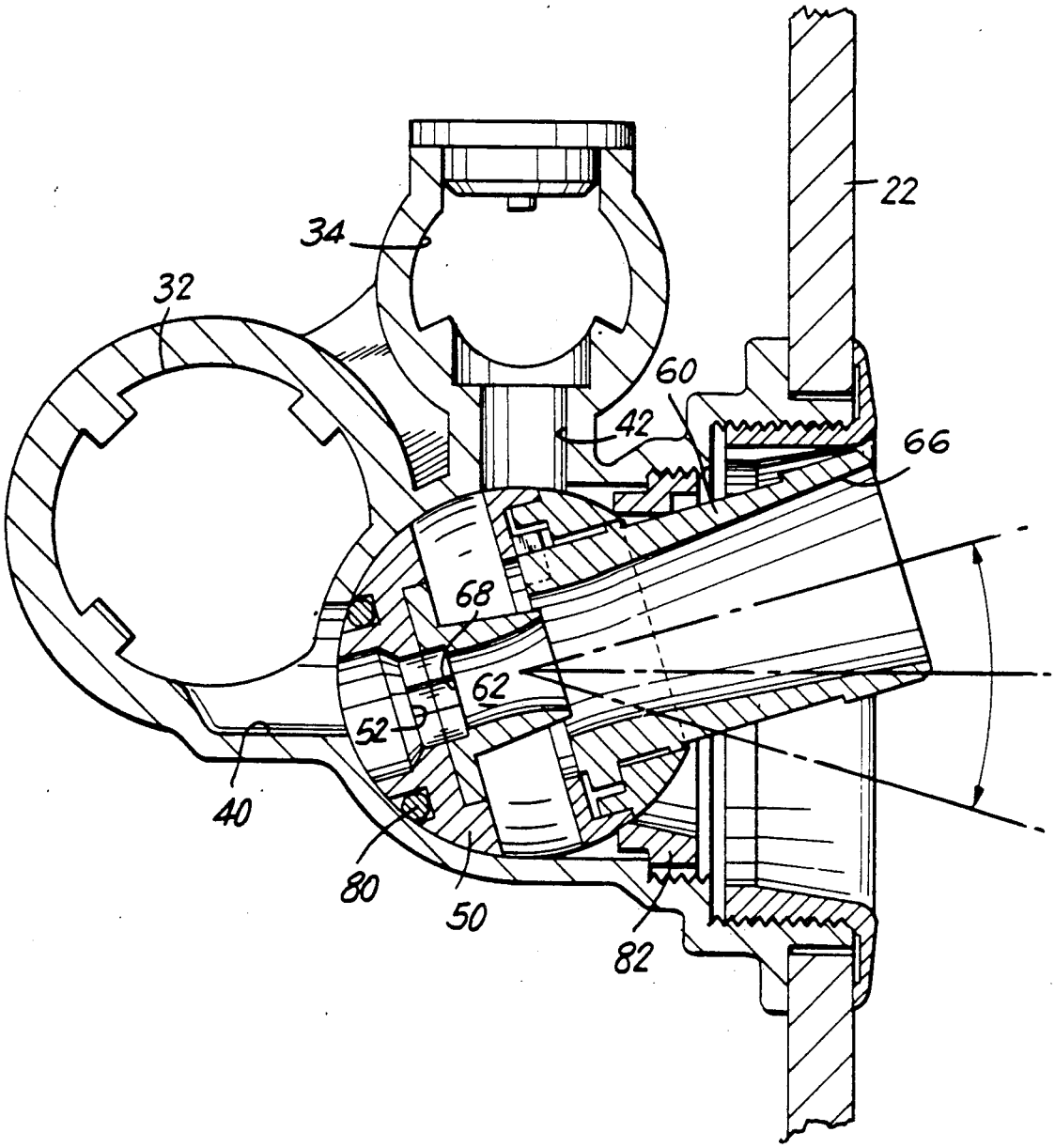
FIG. 9 is a view similar to FIG. 2 but showing the nozzle pivoted to a different position.

FIG. 9 depicts the manner in which nozzle assembly 60 can be pivoted from its central position upward about 10° or downward about 10° to permit the direction of water flow into the tub to be changed. Pivoting of nozzle assembly 60 causes more or less air and/or water to be supplied to the nozzle depending on the orientation of nozzle assembly 60.

Figure 10:
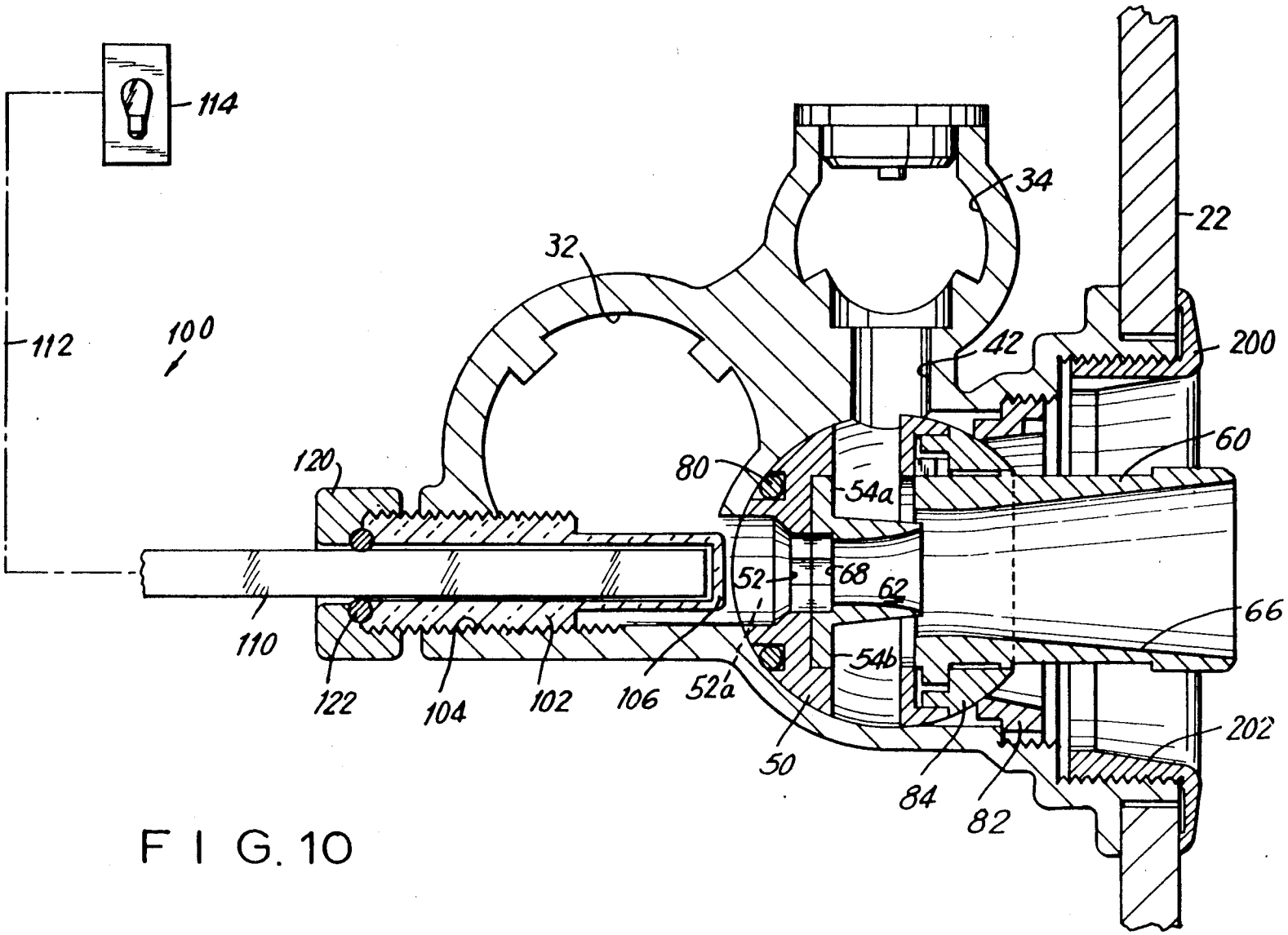
FIG. 10 is a sectional view similar to FIG. 2 but showing the incorporation of a light assembly in the housing assembly.

FIG. 10 shows an embodiment of the present invention which incorporates a light system, generally indicated at 100, in the whirlpool jet assembly of the present invention. Light system 100 includes a transparent or translucent housing 102 threaded in an opening 104 formed in water supply line 32. Tip 106 of housing 102 is positioned proximate opening 52*a* in ball fitting 50. A light tube 110 is positioned within housing 102 and is coupled by an appropriate light transmission line such as a fiber optic rod 112 to a light source 114. A seal nut 120 includes an O-ring 122 for sealing the end of housing 102. Light from light source 114 will travel through light transmission line 112 to light tube 110. Light from light tube 110 will be directed through nozzle assembly 60 into the tub to provide a pleasing effect. The amount of light is reduced when nozzle assembly 60 is pivoted.

Figure 11:
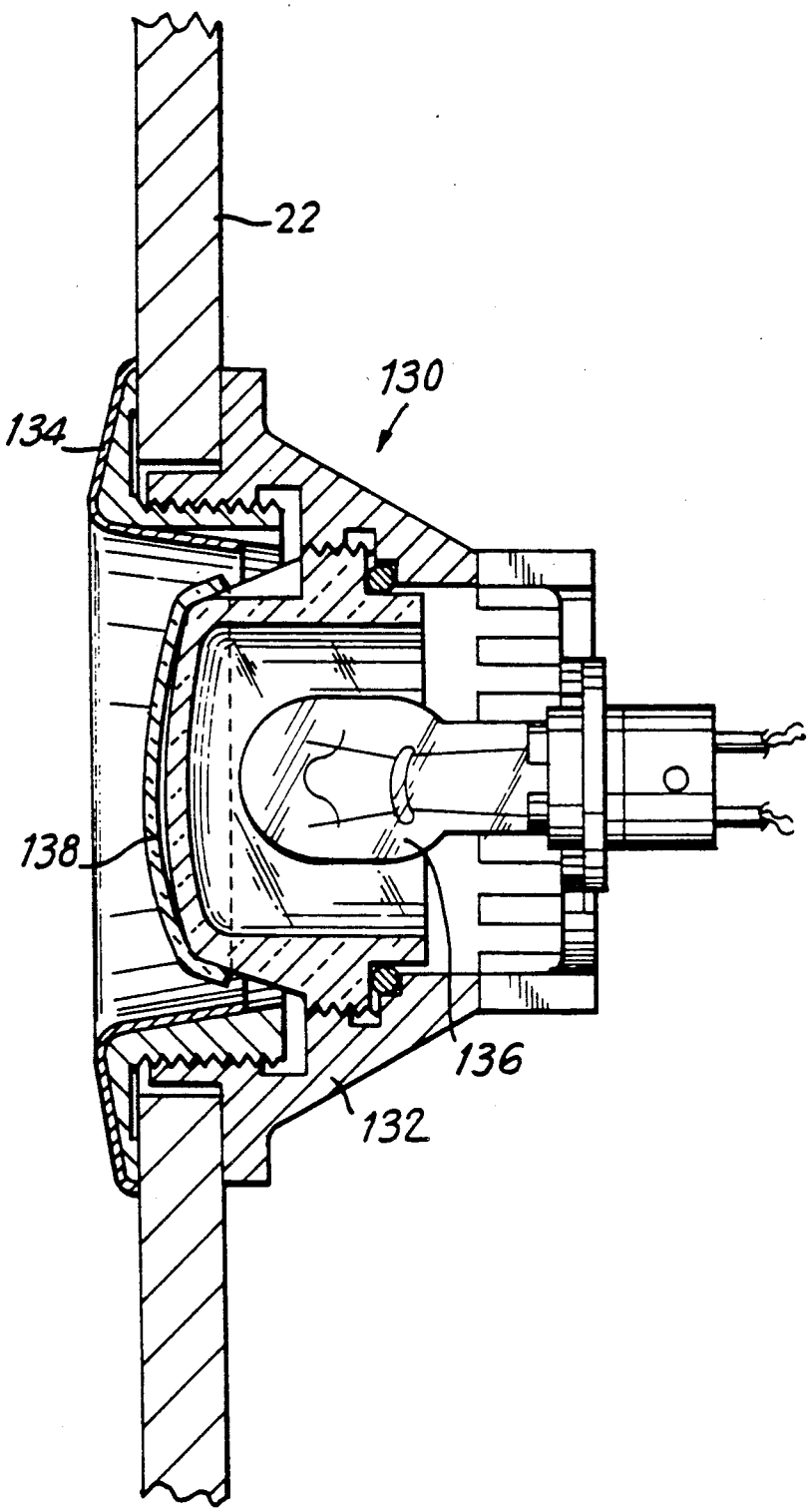
FIG. 11 is a sectional view of an alternative construction of a light assembly for use in a water tub shown in FIG. 1A.

FIG. 11 depicts an alternative embodiment of a light system for use in a water tub which has an appearance similar to the whirlpool jet assembly of the present invention. Light assembly 130 depicted in FIG. 11 includes a housing 132 adapted to be supported on the outside of tub wall 22 by means of a threaded cover plate or escutcheon 134 within tub 20. An appropriate light bulb 136 is supported in light bulb housing 132. A recessed lens 138 sealingly covers light bulb 136 and prevents water in tub 20 from contacting bulb 136. Recessed lens 138 is so designed that it can only be removed by an appropriate tool to prevent inadvertent removal thereof.

It is noted that lens cover 138 is recessed in cove plate 134 so that it provides the same general overall appearance of a mini whirlpool jet of the type described in detail above. The bulb can be replaced from inside of the tub when necessary.

The present invention provides an adjustable flow mini whirlpool jet which is readily adapted for use in whirlpool tubs or the like. The integral one-piece nozzle assembly defining the Venturi jet nozzle, mixing chamber and directional nozzle provides a superior unitary construction not found in the prior art, leading to better reliability and reduced number of parts. The combined ball valve and nozzle assembly in accordance with the present invention does not require a coil spring thereby further reducing the number of parts and resulting in ease of assembly and a reduction in cost.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A whirlpool jet assembly adapted to be mounted in an opening in the wall of a water tub for discharging a water stream into said tub, comprising a housing defining a socket having an air inlet and a water inlet, a ball fitting pivotally supported within said socket and having openings positionable in alignment with said air inlet and water inlet in said socket, a nozzle assembly supported on said ball fitting, said nozzle assembly being a unitary one-piece construction and forming a Venturi nozzle, mixing chamber and directional nozzle in an integral structure, said nozzle assembly being rotatably supported on said ball fitting, said ball fitting and nozzle assembly having shaped openings through which water from said water inlet can flow into said Venturi jet nozzle, rotation of said nozzle assembly with respect to said ball fitting changing the combined shape of said shaped openings to alter the pressure of water flowing through the jet assembly.

2. The whirlpool jet assembly as claimed in claim 1, wherein said ball fitting includes a recessed region for receiving said nozzle assembly.

3. The whirlpool jet assembly as claimed in claim 1, wherein said ball fitting can be pivoted with respect to said air and water inlets in said socket.

4. The whirlpool jet assembly as claimed in claim 1, wherein said nozzle assembly includes an opening adjacent the tip of said Venturi nozzle to permit air from said air inlet flowing through said ball fitting to mix with the jet stream of water emerging from said Venturi nozzle in said mixing chamber.

5. The whirlpool jet assembly as claimed in claim 1, wherein said nozzle assembly is pivotable with said ball fitting to permit adjustment of the flow direction of the water into said tub.

6. The whirlpool jet assembly as claimed in claim 1, wherein said shaped openings in said ball fitting and nozzle assembly are essentially cross-shaped in plan view.

7. The whirlpool jet assembly as claimed in claim 1, wherein said ball fitting includes a projection and said nozzle assembly includes a slot in which said projection extends to limit the amount of rotation of said nozzle assembly with respect to said ball fitting.

8. The whirlpool jet assembly as claimed in claim 5, wherein said nozzle assembly can be pivoted through an angle of about 20°.

9. The whirlpool jet assembly as claimed in claim 1, further comprising light means supported on said housing and positioned essentially in line with said nozzle assembly for directing light into said tub.

10. The whirlpool jet assembly as claimed in claim 9, wherein said light means includes a light tube positioned essentially in line with said nozzle assembly and a light source for directing light to said light tube.

* * * * *